United States Patent [19]

Kaiser et al.

[11] 3,979,176

[45] Sept. 7, 1976

[54] PROCESS FOR THE CONTINUOUS LEVEL PROCESSING OF POLY-ACRYLONITRILE IN THE HYDRATED CONDITION

[75] Inventors: Leo Kaiser, Aesch; Otto Nöthiger, Oberwil, both of Switzerland

[73] Assignee: Ciba-Geigy Corporation, Ardsley, N.Y.

[22] Filed: Jan. 31, 1975

[21] Appl. No.: 545,847

[30] Foreign Application Priority Data

Feb. 6, 1974 Switzerland ..... 1626/74

[52] U.S. Cl. ..... 8/177 R

[51] Int. Cl.[2] ..... D06P 3/70

[58] Field of Search ..... 8/177 R

[56] References Cited

UNITED STATES PATENTS

| | | | |
|---|---|---|---|
| 2,558,735 | 7/1951 | Cresswell | 18/47.5 |
| 3,113,827 | 12/1963 | Moore | 18/48 |
| 3,787,182 | 1/1974 | Eigenmann | 8/177 |

*Primary Examiner*—Joseph L. Schofer
*Assistant Examiner*—A. L. Clingman
*Attorney, Agent, or Firm*—Joseph G. Kolodny; Edward McC. Roberts; Prabodh I. Almaula

[57] ABSTRACT

A process is described for the continuous processing of fibers produced in the wet spinning process, particularly for the continuous dyeing and/or optical brightening of polyacrylonitrile tow in the hydrated condition, wherein, for the obtainment of a level processing effect, the wet tow is spread out, preferably by using spreaders such as curved rods or curved rolls, before being impregnated with the processing liquor, to form a ribbon having a maximum thickness of 2 mm. By this process there is obtained over the whole cross-section, evenly processed polyacrylonitrile tow.

9 Claims, No Drawings

PROCESS FOR THE CONTINUOUS LEVEL PROCESSING OF POLY-ACRYLONITRILE IN THE HYDRATED CONDITION

The invention relates to a process for the continuous level processing of polyacrylonitrile tow, as well as to the tow processed by means of this process.

Fibres made from polyacrylonitrile are obtained by the so-called dry spinning processes, in which the fibres are produced from a solution of the polymer in organic solvents by evaporation of the solvent; or by the so-called wet spinning processes, in which the fibres are precipitated in aqueous solution. In the case of the so-called wet spinning processes, the fibres are washed subsequent to the fibre-forming process (spinning process), and stretched for orientation of the macromolecules, before being dried. In this undried, "swelled," gel-like condition, which is described also as the hydrated condition, the fibres are to a particularly high degree capable of absorbing dyestuffs, e.g., from an aqueous liquor. Dyeing in this condition can therefore be performed under conditions appreciably milder than those required for dyeing the same fibres that have been dried subsequent to spinning. Hence, in the dyeing of tow in the hydrated condition (so-called wet tow), there results savings in energy and time; and there can in addition be the saving of a drying operation.

The processes that have hitherto become known for dyeing of fibres in the gel-like state are those in which essentially the fibres are brought into contact, on a pad dyeing machine or in a simple dye bath, with the dyestuff solution, and subsequently further processed.

It proves however to be very difficult to dye a wet tow consisting of thousands of filaments completely evenly throughout. There have been attempts to solve this problem by various means, such as, e.g., by passing the polyacrylonitrile tow through a confined zone in which the dye liquor is pressed through the tow in a direction perpendicular to the direction of movement of the tow; by dyeing according to the counter-current principle, whereby the wet tow firstly comes into contact with a relatively diluted dyestuff solution; by extensive dewatering of the wet tow before application of the dyestuff, modification of the gel structure and reduction in the rate of dyeing.

All these processes, however, have disadvantages, such as, e.g., that the dyeings were uneven; moreover, the last-mentioned process is applicable only in the case of very thin tow having an overall fineness of below 500 denier. In U.S. Pat. No. 3,113,827 there is moreover described a dyeing process for wet tow, in which the wet tow before dyeing is squeezed out by means of squeezing rollers to obtain a moisture content of 100 to 200%, relative to the weight of the dry fibres. It is not possible however with this process to obtain level dyeings.

It has now been found that, surprisingly, tow can be evenly processed in the hydrated condition if the tow, which normally has an average thickness of about 5 to 10 mm, is spread out by suitable means before processing, so that the thickness of the tow is 0.1 to 2 mm, preferably 0.3 to 1.5 mm.

A suitable means of spreading is, in the first place, the application of so-called "spreaders." Such spreaders, e.g., curved rods or curved rollers, are used in the textile industry in a general manner in continuous processes for the processing of fabrics and, in particular, for chainless mercerising, in order to prevent creases forming in the fabric that is being fed through in the spread-out form.

The wet tow, however, can be spread out also by being passed over a curved surface, or by being sprayed with a water jet from fantail nozzles. Any means by which the wet tow is spread out to a thickness of 0.1 to 2 mm, preferably 0.3 to 1.5 mm, is suitable for the process according to the invention.

The maximum permissible value for the thickness of the tow depends, for the attainment of level processing effects, inter alia on the degree of fineness of the individual filaments; and this value is in general in the case of very thin filaments lower than in the case of coarser filaments, since the liquor cannot penetrate so well through the tow.

It is however undesirable that the wet tow be spread out to the extent that the individual filaments lie side by side. This would obviously be the ideal condition with regard to obtaining level processing effects, but, on the other hand, difficulties would be created in consequence of the excessive danger of the individual filaments breaking. The minimum thickness should therefore not be less than 0.1 mm, preferably not less than 0.3 mm.

The spreading out of the wet tow is carried out advantageously immediately before the tow is impregnated with the solution of the processing agent; however, spreading out can be effected at any stage of the continuous process, provided that the required thickness of the tow is ensured during the actual impregnating process.

Suitable fibre material for the process of the invention is any polyacrylonitrile material obtained by the wet spinning process, provided that the material is in the hydrated condition. Suitable such materials are, e.g., polymers having acid sites and containing at least 50 percent by weight of acrylonitrile units, homopolymers of acrylonitrile which are prepared by means of catalysts that introduce an acid function into the end of the polymer chains, such as, e.g., the redox systems with sulphurous acid anhydride or with a compound able to produce sulphurous acid anhydride, and copolymers which contain at least 50 percent by weight of acrylonitrile units and up to 50 percent by weight of units of at least one ethylene compound copolymerizable with acrylonitrile, of which units at least one contains carboxylic acid groups or sulphonic acid groups or alkali carboxylate groups or alkali sulphonate groups. Also suitable are acrylonitrile polymers having basic sites and containing at least 50 percent by weight of acrylonitrile units and up to 50 percent by weight of units of at least one ethylene compound copolymerizable with acrylonitrile, of which units at least one possesses basic groups.

Copolymers that can be used are, for example: the copolymers of acrylonitrile and itaconic acid, vinylsulphonic acid, styrenesulfphonic acid, allylsulphonic acid, methallylsulphonic acid, vinyloxyarenesulphonic acid, allyloxyarenesulphonic acid, methallyloxyarenesulphonic acid, acryloxyalkoxyarenesulphonic acid, as well as of their alkali salts, and the copolymers of acrylonitrile with basic compounds such as acrylamide, vinyl- and aminoalkyl oxides, acrylates and methacrylates of dialkylamino alcohols, vinylpyridine and alkylated derivatives thereof. The copolymers can in addition contain acrylonitrile units and acid or basic units, units of other ethylenic copolymers copolymerizable with acrylonitrile, such as vinyl chloride or vinylidene chloride, vinyl acetate and alkylacrylates or alkylmethacrylates. It may be mentioned, finally, that for the carrying out of the invention it is likewise possible to use copolymers of acrylonitrile with ethylenic copolymers, other than the last-mentioned, which contain no basic or acid units, provided that these ethylenic copolymers have been prepared by means of catalysts which introduce a terminal acid group at the end of the polymeric chains.

The impregnating liquors used are those that are normally used in practice. The procedure for the preparation of these liquors is advantageously such that the processing agent is dissolved or dispersed in water, and the liquor obtained is brought to the desired pH-value with acid and/or a buffer salt.

Suitable processing agents are those commonly used in textile processing, e.g., dyestuffs, optical brighteners, softening agents, antistatic agents, antioxidants, antimicrobial agents, additives imparting a fireproof finish or enhancing the hydrophilic properties of the material or the resistance to scouring, dirt-, water- and oil-repelling agents and agents improving smell, as well as agents rendering the material fast to shrinking and creasing.

It is possible according to the invention to use dispersed processing agents as well as anionic and, in particular, cationic processing agents.

The process of the invention is particularly suitable for the level dyeing and/or optical brightening of polyacrylonitrile tow. The employed dyestuffs can belong to any class of dyestuffs.

Suitable disperse dyestuffs usable according to the invention are, in particular, azo dyestuffs, as well as anthraquinone, nitro, methine, styryl or azostyryl dyestuffs.

Suitable anionic dyestuffs usuable in the process of the invention are so-called acid wool dyestuffs and also substantive dyestuffs of any desired classes, the coloring part of which is in the anion, such as the alkali or ammonium salts of dyestuff-sulphonic or -carboxylic acids, particularly metal-free or metallised sulphonated mono- or disazo dyestuffs, to which belong also the formazan dyestuffs, their chromium, cobalt, nickel and copper complexes, as well as sulphonated anthraquinone, nitro- and phthalocyanine dyestuffs.

Suitable cationic dyestuffs usable according to the invention are advantageously the commercially readily available salts and metal halides, e.g., zinc chloride double salts of known basic dyestuffs. They are, for example, thiazines, oxazines, diphenylmethanes, triphenylmethanes, rhodamines, azo and anthraquinone dyestuffs, preferably monoazo, methine, azomethine and anthraquinone dyestuffs, all containing onium groups, whereby to be mentioned as onium groups are first of all ammonium groups.

The optical brighteners usable according to the invention can belong to the widest variety of classes. Particularly brilliant brightening effects are obtained with anionic compounds that are derived from the stilbene class, and with cationic compounds that are derived from the coumarin class.

It is also possible in the process of the invention to use impregnating liquors containing several processing agents, for example dyestuff or optical brightener and one or more of the aforementioned processing agents.

The temperature of the impregnating liquor is advantageously in the range of 20° to 100°C, it is in general corresponding to the temperature of the preceding and/or of the subsequent treatment.

The fibres to be processed can, in principle, be in any desired condition of processing between leaving the coagulating bath and final drying. The material concerned is, in particular, stretched or unstretched material with differing levels of water content.

An advantageous embodiment of the process according to the invention is one whereby the wet tow is adjusted, before being impregnated, to have a water content of 30 to 200%, especially 100 to 200%, relative to the dry weight of the fibres. This can be achieved, e.g., by means of squeezing rollers or strippers.

Since the fibres or the spread-out tow being fed through in a continuous dyeing process is constantly removing dyestuffs from the dye bath, special measures regarding apparatus are required in the known processes for the obtainment of a specific shade of colour, which measures ensure that the concentration of dyestuff in the dye bath remains constant. Such measures are, e.g., the measurement of dyestuff concentration, as well as a control of the subsequent addition of controlled amounts of dyestuff solution, e.g. by means of an electronic control plant. If a dyestuff mixture is used for dyeing, as is generally the case, then the individual dyestuffs have to be separately added in controlled amounts according to the dyeing behaviour of the dyestuffs, an arrangement requiring a separate control of the individual dyestuff solutions. Such control equipment is very complicated and expensive and there is frequently a tendency for the level of control to oscillate.

In the process of the invention, a constant take-up of the processing agent by the spread-out tow being fed through is achieved in a very simple manner in that this tow is passed at a constant rate through the impregnating liquor, and is subsequently squeezed out to have an additional absorption of moisture of 20 to 120%, relative to the weight of the dry fibre material. The squeezed-out liquor flows back into the impregnating bath. By means of a constant supply, there is continuously fed to the bath an amount of liquor equal to the amount being removed by the wet tow. The volume of the impregnating bath remains therefor unchanged. The stripped-off or squeezed-out excess of impregnating liquor is reintroduced to the impregnating bath advantageously on the tow-inlet side, together with the freshly supplied impregnating liquor. Since most of the processing agents usable according to the invention are absorbed very rapidly on to the fibres, the liquor dripping from the squeezing rollers has a lower concentration of processing agent. In the impregnating bath, however, there is established after a certain time a constant average concentration, and consequently the absorption of processing agent by the wet tow is also constant.

The concentration of processing agent in the impregnating bath at the point at which the tow enters the impregnating liquor is actually different from the concentration at the point where the tow leaves the impregnating bath; taken overall, however, there is established after a certain time a constant average concentration of processing agent.

In order that this adjustment be effected as rapidly as possible, the volume of the impregnating bath is kept as small as possible, i.e., the amount of impregnating liquor in which the spread-out wet tow is immersed is 100 to 500 times the amount of the immersed tow, relative to the dry weight of the fibres.

Apart from operating with the smallest possible volume of liquor in the impregnating bath, it has also proved advantageous to initially fill the impregnating bath with a processing-agent liquor diluted with water to the extent of 30 to 60 percent by weight, corresponding to the average concentration of processing agent which, from experience, is established after attainment of equilibrium in the impregnating bath.

In this manner, only small amounts of fibre material have been processed, on the starting up of the plant, before the ultimate average concentration of processing agent in the impregnating bath obtains. The amount of waste is therefore very slight. There are subsequently no complicated measures required for the control of concentration. Merely the amount of impregnating liquor being taken up by the wet tow is continuously made up.

By the process of the invention there is obtained, over the whole cross-section, evenly processed polyacrylonitrile tow.

The following examples serve to illustrate the invention without limiting its scope to them. The temperatures in the examples are given in degrees centigrade, and percentages are expressed as percent by weight.

EXAMPLE 1

An unstretched polyacrylonitrile tow in the hydrated condition having an overall titre of 300,000 denier, which consists of 20,000 individual filaments having a titre of 15 denier and which has a water content of 120%, relative to the dry weight of the fibres, is passed over curved rods (spreaders) and in this way spread out to form a ribbon having a thickness of 1.2 mm. In this spread-out condition, the tow is impregnated at 20° with an aqueous dye liquor which contains per liter 5 g of the dyestuff of formula I, whereby at the commencement of dyeing the impregnating bath is filled with a liquor diluted to the extent of 50% with water:

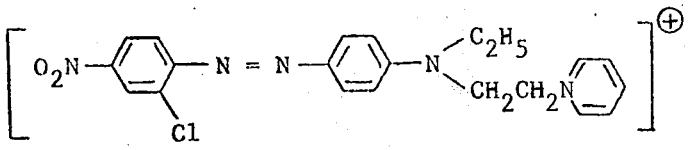

(I)

The amount of dye liquor in the bath is 150 times the amount of fibre ribbon, relative to the dry weight of the fibres, which is immersed in the bath. After leaving the impregnating liquor, the ribbon is squeezed out by means of squeezing rollers to give an additional liquor absorption of 35%, with the excess dye liquor being added again to the impregnating bath on the tow-inlet side. From a storage container there is continuously flowing into the bath an amount of dye liquor containing per liter 5 g of Dyestuff I, which amount is equal to the amount being removed from the bath by the wet tow. The dyed polyacrylonitrile tow is subsequently stretched and further processed in the usual manner.

There is obtained a levelly red-dyed polyacrylonitrile tow.

If by this procedure there is dyed stretched polyacrylonitrile tow that is still in the hydrated condition, i.e., that has not been dried, then likewise there are obtained level dyeings.

If, instead of Dyestuff I, there are used Dyestuffs II to VI of Table 2, and dyeing is performed by a method analogous to that described in Example 1, but under the conditions given in the following Table 1, then likewise there are obtained very level dyeings.

| Example | 2 | 3 | 4 |
|---|---|---|---|
| Overall titre of the wet tow | 100,000 | 75,000 | 30,000 |
| Number of individual filaments | 33,333 | 12,500 | 7,500 |
| Water content of the wet tow before immersion in the impregnating liquor | 180% | 132% | 160% |
| Spreader | curved rollers | curved surface | curved rods |
| Thickness of the tow [mm] | 0.3 | 0.5 | 2 |
| Dyestuff | 3 g of Dyestuff II per liter | 1 g of Dyestuff III per liter 4 g of Dyestuff II per liter | 1 g of Dyestuff V per liter/6 g of Dyestuff IV per liter |
| Amount of dye liquor (relative to the dry weight of the immersed fibres) | 450 | 300 | 500 |
| Liquor temperature | 50° | 25° | 20° |
| Liquor absorption | 50% | 105% | 40% |
| Removal of the excess of liquor by | squeezing rollers | stripper | stripper |
| Shade of the dyed tow | yellow | green | orange |

TABLE 2

Constitution of the dyestuffs

Dyestuff of formula II

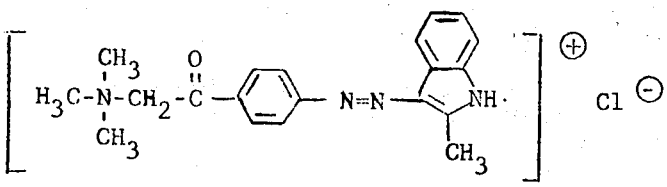

Dyestuff of formula III

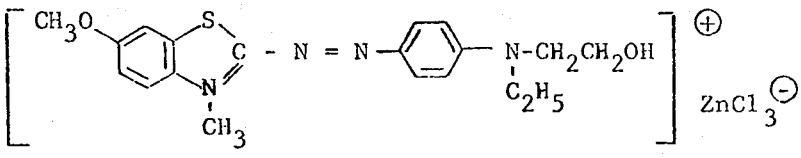

Dyestuff of formula IV

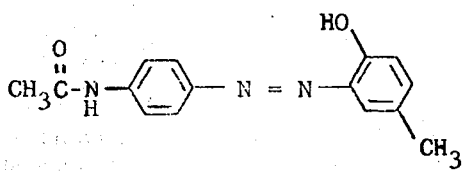

Dyestuff of formula V

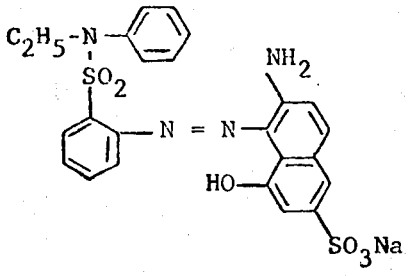

Dyestuff of formula VI

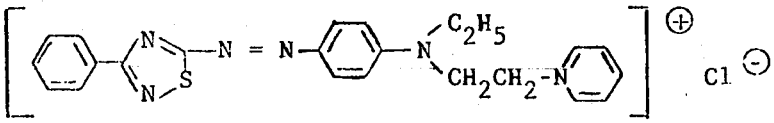

EXAMPLE 5

A stretched polyacrylonitrile tow in the hydrated condition having an overall titre of 1300 denier, which consists of 650 individual filaments and has a water content of 100% relative to the dry weight of the fibres, and which has been freed from spinning chemicals by rinsing, is passed over curved rods and thus spread out to form a ribbon 0.3 mm in thickness. In this spread-out condition, the ribbon is impregnated with an aqueous dye liquor at 80°, which contains per liter 2 g of the dyestuff of formula VI from Table 2 and 5 g of the softening agent of formula VII, whereby at the commencement of impregnating the impregnating bath is filled with a liquor diluted with water to the extent of 30%:

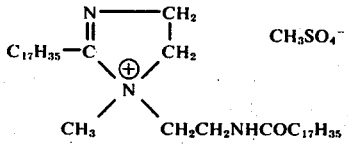

(VII)

The amount of impregnating liquor in the bath is 150 times the amount of fibre ribbon, relative to the dry weight of the fibres, which is immersed in the bath. After leaving the impregnating bath, the ribbon is squeezed out by means of squeezing rollers to give an additional liquor absorption of 60%, with the excess impregnating liquor being added again to the impregnating bath on the tow-inlet side. From a storage container there is continuously flowing into the bath an amount of impregnating liquor containing per liter 2 g of the dyestuff of formula VI and 5 g of the softening agent of formula VII, which amount is equal to that being removed from the bath by the wet tow. The dyed polyacrylonitrile tow is subsequently dried, and further processed in the usual manner.

There is obtained an evenly red-dyed polyacrylonitrile tow having a soft and full handle.

EXAMPLE 6

A stretched polyacrylonitrile tow in the hydrated condition having an overall titre of 600,000 denier, which consists of 50,000 individual filaments and has a water content of 130% relative to the dry weight of the fibres, and which has been freed from spinning chemicals by rinsing, is passed over curved rods and thus spread out to form a ribbon 2 mm in thickness. In this spread-out condition, the ribbon is impregnated with an aqueous liquor at 20°, which contains per liter 35 g of the antistatic agent of formula VIII, whereby at the commencement of impregnating the impregnating bath is filled with a liquor diluted with water to the extent of 30%:

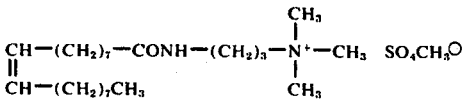

VIII

The amount of impregnating liquor in the bath is 100 times the amount of fibre ribbon, relative to the dry weight of the fibres, which is immersed in the bath. After leaving the impregnating bath, the ribbon is squeezed out by means of squeezing rollers to give an additional liquor absorption of 30%, with the excess impregnating liquor being fed back to the impregnating bath on the tow-inlet side of the bath. From a storage container there is continuously flowing into the bath an amount of impregnating liquor containing per liter 35 g of the antistatic agent of formula VIII, which amount is equal to that being removed from the bath by the wet tow. The wet tow is subsequently dried, and further processed in the customary manner.

There is obtained a polyacrylonitrile tow having a very even antistatic finish.

We claim:

1. A process for the continuous treatment, of hydrated polyacrylonitrile tow, with a dyestuff or an optical brightening agent to give a level treatment effect, comprising the steps of:

a. spreading out the wet tow to form a ribbon having a maximum thickness of 2 mm. and b. impregnating the spread-out tow ribbon with a processing liquor that contains a dyestuff or an optical brightener.

2. Process according to claim 1, wherein the spread-out tow is impregnated by being immersed in the processing liquor and wherein the weight of processing liquor is 100 to 500 times the dry weight of wet tow to be treated.

3. Process according to claim 1 wherein the wet tow is spread out to a thickness of 0.3 to 1.5 mm.

4. Process according to claim 1, wherein the spreading out of the tow is carried out by means of a curved rod or a curved roller.

5. Process according to claim 1, wherein the treatment is performed before stretching of the tow.

6. Process according to claim 1, wherein the treatment is performed after stretching of the tow.

7. Process according to claim 1, wherein a constant absorption of the processing liquor is obtained by a system in which, as a result of a constant supply of liquor, the amount of liquor supplied is exactly equal to that taken up by the tow.

8. Process according to claim 1, comprising the further subsequent steps of c. removing any excess of processing liquor by stripping or squeezing and d. returning the stripped-off or squeezed-out excess of processing liquor to the processing liquor on the tow-inlet side of the processing liquor bath.

9. The polyacrylonitrile tow levelly processed by the process of claim 1.

* * * * *